US010287509B2

(12) United States Patent
Mehra et al.

(10) Patent No.: US 10,287,509 B2
(45) Date of Patent: May 14, 2019

(54) OIL CONDITIONING UNIT AND PROCESS

(71) Applicant: Hellervik Oilfield Technologies LLC, Bismarck, ND (US)

(72) Inventors: Yuv R. Mehra, Montgomery, TX (US); Stephen R. David, Apple Valley, MN (US)

(73) Assignee: HELLERVIK OILFIELD TECHNOLOGIES LLC, Bismarck, ND (US)

( * ) Notice: Subject to any disclaimer, the term of this patent is extended or adjusted under 35 U.S.C. 154(b) by 139 days.

(21) Appl. No.: 15/204,633

(22) Filed: Jul. 7, 2016

(65) Prior Publication Data

US 2017/0204337 A1 Jul. 20, 2017

(51) Int. Cl.

| | |
|---|---|
| ***C10G 7/00*** | (2006.01) |
| ***C10G 7/02*** | (2006.01) |
| ***C10G 33/04*** | (2006.01) |

(52) U.S. Cl.

CPC ..... *C10G 7/00* (2013.01); *C10G 7/02* (2013.01); *C10G 33/04* (2013.01)

(58) Field of Classification Search

CPC ..... C10G 7/00; C10G 7/02; C10G 33/04
See application file for complete search history.

(56) References Cited

U.S. PATENT DOCUMENTS

| | | | | |
|---|---|---|---|---|
| 1,611,370 | A | | 12/1926 | Primrose |
| 1,767,341 | A | | 6/1930 | Bimel |
| 2,128,898 | A | | 9/1938 | Angell |
| 2,296,992 | A | | 7/1939 | Gary |
| 2,225,949 | A | | 12/1940 | Bennett |
| 2,322,635 | A | | 6/1943 | Keith, Jr. |
| 2,773,559 | A | | 12/1956 | Cottle |
| 2,970,107 | A | | 1/1961 | Gilmore |
| 3,837,353 | A | * | 9/1974 | Hopkin ..... C10G 35/24 137/391 |
| 4,124,496 | A | | 11/1978 | Cummings |
| 4,127,393 | A | | 11/1978 | Timmins et al. |
| 5,004,552 | A | | 4/1991 | Al-Yazdi |
| 5,030,339 | A | | 7/1991 | Czarnecki |
| 5,389,242 | A | | 2/1995 | Lermite et al. |

(Continued)

OTHER PUBLICATIONS

International Patent Application No. PCT/US2017/040371, International Search Report and Written Opinion dated Oct. 3, 2017, 9 pages.

(Continued)

*Primary Examiner* — Randy Boyer
*Assistant Examiner* — Juan C Valencia
(74) *Attorney, Agent, or Firm* — Fredrikson & Byron, P.A.

(57) ABSTRACT

An oil conditioning unit includes a pump for receiving unstabilized crude oil at a first pressure and pumping the unstabilized crude oil at a second pressure higher than the first pressure, a first pre-heater downstream of the pump for heating the unstabilized crude oil to a first temperature, and a degassing vessel downstream of the first pre-heater. The degassing vessel is configured to separate light hydrocarbon gases from the unstabilized crude oil at the first temperature to produce stabilized crude oil having a Reid Vapor Pressure less than or equal to 13.7 psia. In some examples, the degassing vessel is configured to produce stabilized crude oil having a Reid Vapor Pressure well below 13.7 psia.

16 Claims, 4 Drawing Sheets

(56) References Cited

U.S. PATENT DOCUMENTS

| | | | | |
|---|---|---|---|---|
| 5,645,692 | A | 7/1997 | Gourlia et al. | |
| 6,338,749 | B1 | 1/2002 | Fulk et al. | |
| 7,309,417 | B2 | 12/2007 | Runbalk | |
| 7,568,363 | B2 | 8/2009 | Runbalk | |
| 7,850,843 | B2 | 12/2010 | Zare | |
| 8,840,706 | B1 | 9/2014 | Srinivasachar | |
| 9,057,327 | B2 * | 6/2015 | John | F02C 7/224 |
| 9,109,166 | B2 | 8/2015 | Van Amelsvoort et al. | |
| 9,157,035 | B1 | 10/2015 | Ball, IV et al. | |
| 9,988,581 | B2 * | 6/2018 | Meyer | C10G 31/06 |
| 2007/0267325 | A1 | 11/2007 | Vu | |
| 2009/0289002 | A1 | 11/2009 | Oserod | |
| 2014/0001097 | A1 | 1/2014 | Jothy et al. | |
| 2014/0138287 | A1 | 5/2014 | De Klerk et al. | |
| 2014/0275677 | A1 | 9/2014 | Baldassari et al. | |
| 2015/0021235 | A1 | 1/2015 | Erikson | |
| 2015/0267129 | A1 | 9/2015 | Meyer | |
| 2016/0122658 | A1 | 5/2016 | O'Rear et al. | |
| 2016/0145499 | A1 | 5/2016 | Choi et al. | |

OTHER PUBLICATIONS

Campbell, "Vapor-Liquid Equilibrium Behavior," Gas Conditioning and Processing V. 1: The Basic Principles, 9th Edition, Jan. 2014, pp. 117, 118 and 120.

Campbell, "Crude Oil and Condensate Stabilizers," Gas Conditioning and Processing V. 2: The Equipment Modules, 9th Edition, Jan. 2014, pp. 327-329.

Kister, "Component Trapping in Distillation Towers: Causes, Symptoms and Cures," CEP Magazine, Aug. 2004, pp. 22-33.

Lieberman, "Drying Light End Towers is Critical to Preventing Problems," Oil and Gas Journal, Feb. 16, 1981, pp. 100-102.

Morris et al., "Crude Stabilizer Can Save Money Offshore," Oil and Gas Journal, May 7, 1984, pp. 112-116.

"Reasonable Progress Evaluation for Heater-Treater Source Category," Colorado Department of Public Health and Environment—Air Pollution Control Division, 2011, pp. 1-6.

"Heater Treater," ViENERG, Blog Post, Sep. 14, 2015, <http://vienerg.com/horizontal-heater-treater.html>, 3 pages.

"Vertical Heater Treater," ViENERG, Blog Post, Sep. 15, 2015, <http://vienerg.blogspot.com>, 2 pages.

* cited by examiner

OIL CONDITIONING UNIT AND PROCESS

TECHNICAL FIELD

This disclosure relates to processing of unstabilized crude oil and, more particularly, to an oil conditioning unit for conditioning unstabilized crude oil to meet a vapor pressure specification for safe handling, transport, and/or storage.

BACKGROUND

The presence of light hydrocarbons in crude oil contributes to the volatility of the oil. The presence of substantial amounts of propane, butanes, and lighter hydrocarbons in the crude oil can cause an increase in the vapor pressure within the container in which the crude oil is handled, stored, or transported, creating a risk for explosion during handling, storage, and transport of the crude oil. A number of rail car accidents have recently occurred, which resulted in fires and casualties due to explosions of containers carrying volatile crude oil. The risk of explosion due to volatility increases when crude oil is produced and/or stored in a cold climate and subsequently shipped to a warmer climate, as volatility of the crude oil increases with an increase in temperature. This issue is particularly prevalent for crude oil produced in the Bakken Shale formation, where the crude oil is especially volatile.

Due to the recent disasters and high volatility of the crude oil in the Bakken Shale formation, in April 2015, North Dakota implemented regulations requiring the Reid Vapor Pressure (RVP) of transported crude oil to be no greater than 13.7 psia or 1 psia less than the vapor pressure of stabilized crude oil as defined in the latest version of ANSI/API RP3000, whichever is lower. One common attempt at reducing the volatility of the crude oil to comply with regulations has been to use a heater-treater. However, heater-treaters are not designed to run at temperatures necessary to stabilize the crude oil. While it is possible to run heater-treaters at high enough temperatures to reduce the volatility of the crude, at such temperatures, the fire tube of the heater-treater is highly susceptible to coking, and eventually fails as a result.

SUMMARY

In general, this disclosure relates to an oil conditioning unit and process for producing stabilized crude oil that meets vapor pressure requirements for safe handling, transport, and/or storage. Unstabilized crude oil is pumped to increase the pressure of the oil, and subsequently heated to a specified temperature prior to entering a degassing vessel. The heated unstabilized crude oil remains in the degassing vessel for a residence time sufficient to allow for removal of enough dissolved light hydrocarbons to produce stabilized crude for safe handling, storage and transport. The separated light hydrocarbon gases can be sent to flare, consumed as a fuel, or sent to a natural gas liquid recovery system.

In one embodiment of this disclosure, an oil conditioning unit includes a pump for receiving unstabilized crude oil at a first pressure and pumping the unstabilized crude oil to a second pressure higher than the first pressure, a first pre-heater downstream of the pump for heating the unstabilized crude oil to a first temperature, and a degassing vessel downstream of the first pre-heater. The degassing vessel is configured to separate light hydrocarbon gases from the unstabilized crude oil at the first temperature to produce stabilized crude oil having a Reid Vapor Pressure less than or equal to 13.7 psia.

In another embodiment of this disclosure, an oil conditioning system of this disclosure includes a heater-treater configured to treat unstabilized crude oil, an oil conditioning unit downstream of the heater-treater, and a storage vessel for storing stabilized crude oil from the oil conditioning unit. The oil conditioning unit includes a pump for receiving unstabilized crude oil at a first pressure and pumping the unstabilized crude oil to a second pressure higher than the first pressure, a first pre-heater downstream of the pump for heating the unstabilized crude oil to a first temperature, and a degassing vessel downstream of the first pre-heater. The degassing vessel is configured to separate light hydrocarbon gases from the unstabilized crude oil at the first temperature to produce stabilized crude oil having a Reid Vapor Pressure less than or equal to 13.7 psia.

In another embodiment of this disclosure, a method for stabilizing crude oil includes pumping unstabilized crude oil with a pump from a first pressure to a second pressure higher than the first pressure, heating the unstabilized crude oil from the pump with a pre-heater at a first temperature, and separating light hydrocarbon gases from the unstabilized crude oil in a degassing vessel at the first temperature to produce stabilized crude oil and separated light hydrocarbon gases. The stabilized crude oil has a Reid Vapor Pressure less than or equal to 13.7 psia.

The details of one or more examples are set forth in the accompanying drawings and the description below. Other features, objects, and advantages will be apparent from the description and drawings, and from the claims.

DETAILED DESCRIPTION

The following detailed description is exemplary in nature and is not intended to limit the scope, applicability, or configuration of the invention in any way. Rather, the following description provides some practical illustrations for implementing examples of the present invention. Examples of constructions, materials, dimensions, and manufacturing processes are provided for selected elements, and all other elements employ that which is known to those of ordinary skill in the field of the invention. Those skilled in the art will recognize that many of the noted examples have a variety of suitable alternatives.

The terms and phrases as indicated in quotation marks (“ ”) are intended to have the meaning ascribed to them applied throughout the entire disclosure, including in the claims, unless clearly indicated otherwise in context.

“Reid Vapor Pressure” or “RVP” means the absolute vapor pressure exerted by a liquid at 100 degrees Fahrenheit (° F.) expressed as pounds per square inch absolute (“psia”). RVP is a close approximation to True Vapor Pressure (TVP), which is useful in the operation and design of handling, storage, and transportation equipment. RVP is easy to measure in the field and can be easily converted to TVP through numerous available nomographs and charts.

"Stabilized crude oil" or "stabilized crude" means crude oil with an RVP no greater than 13.7 psia or 1 psia less than the vapor pressure of stabilized crude oil as defined in the latest version of ANSI/API RP3000, whichever is lower. As of the date of this disclosure, "stabilized crude oil" or "stabilized crude" is crude oil with an RVP no greater than 13.7 psia.

"Unstabilized crude oil" or "unstabilized crude" means crude oil with an RVP greater than the lower of 13.7 psia or 1 psia less than the vapor pressure of stabilized crude oil as defined in the latest version of ANSI/API RP3000. As of the date of this disclosure, "unstabilized crude oil" or "unstabilized crude" is crude oil with an RVP greater than 13.7 psia.

In order to produce the stabilized crude, an example oil conditioning unit of this disclosure removes dissolved light hydrocarbons from the unstabilized crude, which typically has an RVP ranging from 14 to 25 psia. The example oil conditioning unit is capable of producing five hundred standard barrels (42 U.S. gallons/barrel) of stabilized crude per day with an RVP as low as 6 psia. The 500 barrels of stabilized crude with an RVP of 6 psia can subsequently be blended with unstabilized crude to produce as many as 1900 standard barrels of stabilized crude.

Figure 1A:
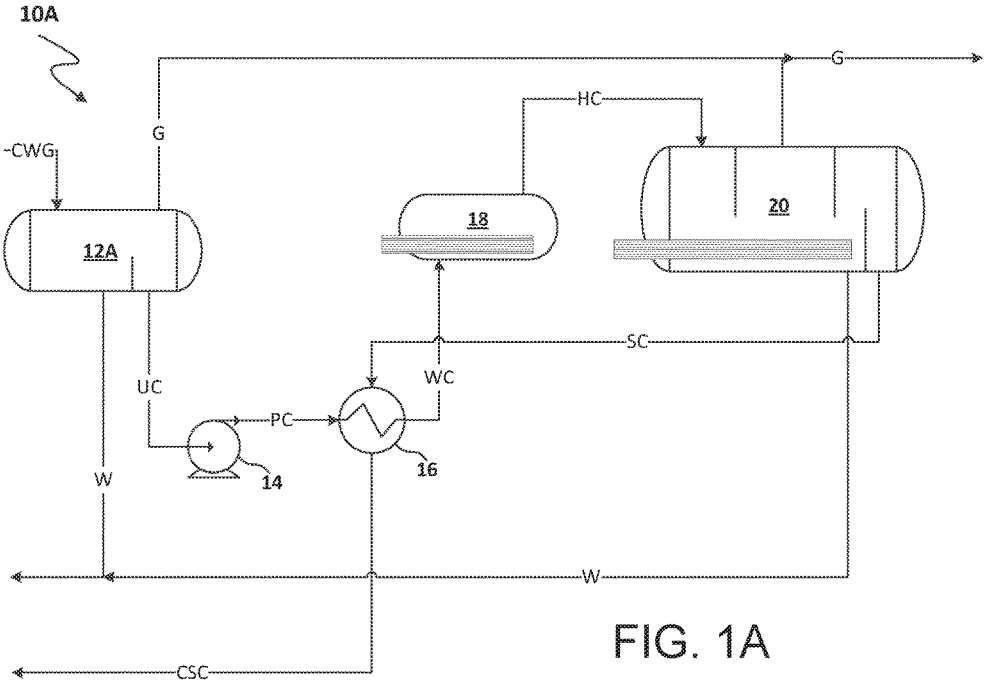
FIG. 1A is a schematic diagram illustrating an example oil conditioning unit which conditions unstabilized crude oil directly from an oil well.

FIG. 1A is a schematic diagram illustrating oil conditioning unit 10A, which conditions unstabilized crude oil directly from an oil well into stabilized crude oil. Oil conditioning unit 10A includes three-phase separator 12A, pump 14, cross-exchanger 16, preheater 18, and degassing vessel 20. Oil conditioning unit 10A conditions unstabilized crude oil UC by heating unstabilized crude oil UC to a temperature at which light dissolved hydrocarbons can be removed from hot unstabilized crude oil HC in degassing vessel 20 to produce stabilized crude oil SC.

In the oil conditioning process performed by oil conditioning unit 10A, mixture of unstabilized crude oil, water, and gas CWG enters three-phase separator 12A, where some hydrocarbon gas G and water W is separated from mixture CWG. The remaining unstabilized crude UC flows through pump 14, where unstabilized crude UC is pressurized. Pressurized unstabilized crude PC subsequently flows through cross-exchanger 16, and warm unstabilized crude WC exits cross-exchanger and enters preheater 18. Preheater 18 heats warm unstabilized crude WC, and hot unstabilized crude HC exits preheater 18 and enters degassing vessel 20. Hot unstabilized crude HC remains within degassing vessel 20 for a residence time sufficient to remove enough dissolved light hydrocarbons to produce stabilized crude SC. Stabilized crude SC passes through cross-exchanger 16 where stabilized crude SC is cooled by pressurized unstabilized crude PC.

Mixture CWG enters three-phase separator 12A at a temperature between 55 and 110° F. and can enter three-phase separator 12A at a pressure between 5 psia and 50 psia. In one example, unstabilized crude enters three-phase separator 12A at a pressure between 35 and 40 psia. Three-phase separator 12A separates mixture CWG into free water W, liquid unstabilized hydrocarbon crude UC, and dissolved hydrocarbon gas G. The dissolved hydrocarbon gas exits three-phase separator 12A and is either sent directly to flare, consumed as a fuel, or is processed through natural gas liquid (NGL) recovery system 30 (described with respect to FIG. 3 below) prior to being sent to flare or consumed as a fuel. The free water W exits three-phase separator 12A and is sent to storage. In one example, three-phase separator 12A can include a heating element (not shown in FIG. 1A) to help facilitate separation of mixture CWG into the three-phases UC, W, and G described above. In this example, three-phase separator 12A operates as a conventional heater-treater, as described with reference to element 11 in FIG. 1B below.

Unstabilized crude UC exits three-phase separator 12A and is pumped up to a pressure between 20 psia and 150 psia by pump 14. In some examples, unstabilized crude is pumped up to a pressure between 50 and 75 psia. This removes the need for a compressor downstream of degassing vessel 20 to provide enough pressure to send light hydrocarbon gas G to flare or process light hydrocarbon gas G in NGL recovery system 30 prior to being sent to flare or being used a fuel source. Pressurized unstabilized crude PC leaves pump 14 at a temperature of about 55° F., and is subsequently warmed to about 180° F. in cross-exchanger 16.

Cross-exchanger 16 uses pressurized unstabilized crude PC pumped from pump 14 to cool stabilized crude SC exiting degassing vessel 20. Stabilized crude SC exits degassing vessel 20 at a temperature of up to 300° F., which is too high for storage. Thus, cross-exchanger 16 cools stabilized crude SC to between 120 and 180° F., and upon exiting cross-exchanger 16, cooled stabilized crude CSC is sent to storage. Cross-exchanger 16 is an optional feature of oil conditioning unit 10A. Therefore, in some examples, oil conditioning unit 10A does not include cross-exchanger 16 and pressurized unstabilized crude PC flows directly to pre-heater 18.

When cross-exchanger 16 is used in oil conditioning unit 10A, cross-exchanger eliminates the need for a separate cooler (not shown in FIG. 1A) to cool stabilized crude SC exiting degassing vessel 20. Additionally, cross-exchanger 16 conserves energy within oil conditioning unit 10A by simultaneously heating pressurized unstabilized crude PC and cooling stabilized crude SC. As described above, pressurized unstabilized crude PC needs to be heated to approximately 240° F. in order to be conditioned into stabilized crude SC. Therefore, cross-exchanger 16 conserves energy by providing a mechanism for adding some of the required heat to unstabilized crude PC to produce hot unstabilized crude HC while simultaneously providing necessary cooling to stabilized crude SC to produce cooled stabilized crude CSC.

Warm unstabilized crude WC exits cross-flow heater exchanger 16 and is further heated in pre-heater 18. In one example, pre-heater 18 is a single electric heater. In another example, pre-heater 18 includes two electric heaters for redundancy. In this example, if one of the heaters fails, the other heater can still provide sufficient heat to adequately raise the temperature of warm unstabilized crude WC. Additionally, one heater can be replaced without having to disrupt the operation of oil conditioning unit 10A. Electric heat is advantageous, as heating with a fire tube, for example, can result in coking due to the high operational temperatures required when using a fire tube. In one example, pre-heater 18 is a flooded heat exchanger under pressure, which prevents vaporization from occurring when heating unstabilized crude WC. The operational temperature of pre-heater 18 is limited to a maximum of 400° F. so that coking does not occur, thus preventing failure of pre-heater 18.

Pre-heater 18 heats warm unstabilized crude to approximately 240° F., and hot unstabilized crude HC exits pre-heater 18. In some examples, pre-heater 18 heats warm unstabilized crude WC to between 170 and 300° F. When cross-exchanger 16 is not included in oil conditioning unit 10A, pressurized unstabilized crude PC enters pre-heater 18 at a temperature as low as 55° F., and pre-heater 18 heats pressurized unstabilized crude PC to approximately 240° F. In some examples, pre-heater 18 heats pressurized unstabilized crude PC to between 170 and 275° F.

Hot unstabilized crude HC exits pre-heater 18 and enters degassing vessel 20, where hot unstabilized crude HC is conditioned to produce stabilized crude SC. Hot unstabilized crude HC enters degassing vessel at a temperature between 200 and 275° F. and at a pressure between 20 and 100 psia. In one example, hot unstabilized crude HC enters degassing vessel 20 at a temperature of 240° F. and at a pressure of 35 psia. Degassing vessel 20 separates light hydrocarbon gas and any free water from hot unstabilized crude HC in order to condition hot unstabilized crude HC into stabilized crude SC.

Degassing vessel 20 maintains hot unstabilized crude HC at an appropriate temperature for a sufficient residence time in order to reduce the volatility of hot unstabilized crude HC sufficiently to produce stabilized crude SC. In one example, the temperature within degassing vessel 20 is maintained at 240° F. for a residence time between 15 and 60 minutes. In another example, the residence time is between 30 and 45 minutes. In another example, the residence time is 30 minutes. The operation of degassing vessel 20 is described in further detail below with respect to FIG. 2.

As described above, in one example, stabilized crude SC exiting degassing vessel 20 can be cooled in cross-exchanger 16 prior to being sent to storage as cooled stabilized crude CSC. In another example, oil conditioning unit 10A can include a cooler (not shown in FIG. 1A) for cooling stabilized crude SC instead of cross-exchanger 16. Water W separated from hot unstabilized crude HC in degassing vessel 20 exits degassing vessel 20 and can be sent to storage. Total water flow W to storage is the sum of water W from three-phase separator 12A and water W from degassing vessel 20. Light hydrocarbon gas G separated from hot unstabilized crude HC in degassing vessel 20 exits degassing vessel 20 and can either be sent directly to flare or used as a fuel source, or sent to processing in NGL recovery system 30 prior to being sent to flare or being used as a fuel source. Total gas flow G to flare, for use as a fuel, or to NGL recovery system 30 is the sum of gas flow G from three-phase separator 12A and light gases G from degassing vessel 20.

Figure 1B:
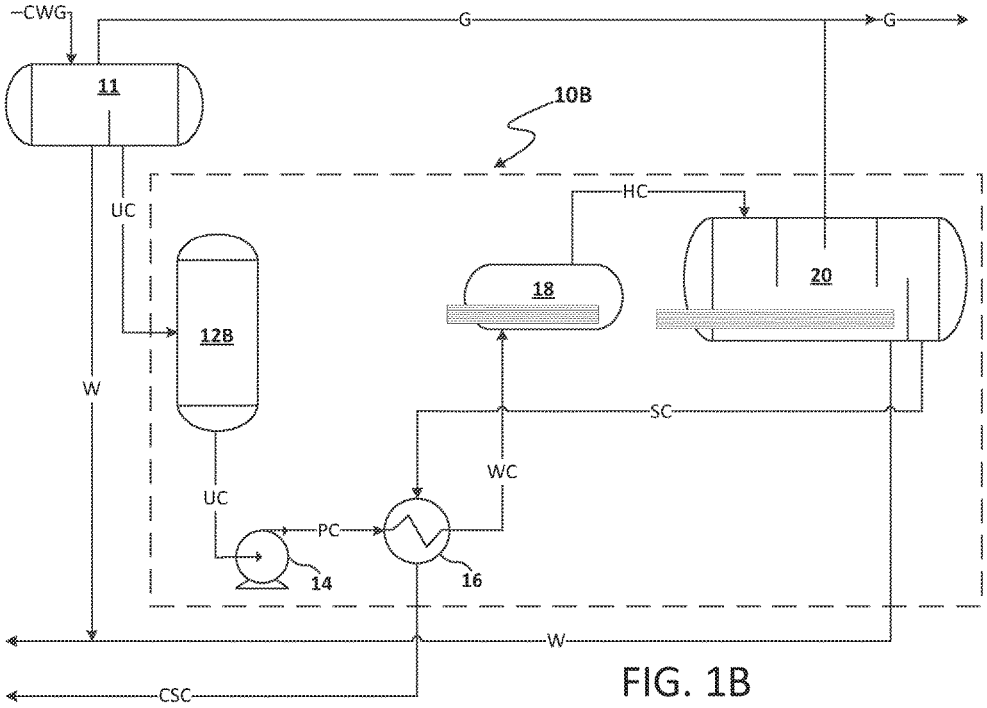
FIG. 1B is a schematic diagram illustrating an example oil conditioning unit which conditions unstabilized crude oil from a heater-treater.

FIG. 1B is a schematic diagram illustrating oil conditioning unit 10B which conditions crude oil from heater-treater 11. Oil conditioning unit 10B includes surge drum 12B, pump 14, cross-exchanger 16, preheater 18, and degassing vessel 20. Oil conditioning unit 10B functions in a substantially similar manner to oil conditioning unit 10A of FIG. 1A, except oil conditioning unit 10B includes surge drum 12B instead of three-phase separator 12A. Oil conditioning unit 10B includes surge drum 12B due to the fact that unstabilized crude UC is processed in heater-treater 11 prior to entering oil conditioning unit 10B, instead of entering oil conditioning unit 10B directly from an oil well as in FIG. 1A.

Heater-treater 11 receives mixture of unstabilized crude, water, and gas CWG from an oil well and separates free water W and some light hydrocarbon gas G from mixture CWG, as well as breaks down emulsions in mixture CWG. Mixture CWG enters heater-treater 11 at a temperature between 55 and 100° F. and can enter heater-treater 11 at a pressure between 5 psia and 50 psia. In one example, unstabilized crude enters heater-treater 11 at a pressure between 35 and 40 psia.

Heater-treater 11 includes a gas fire tube that can be submerged in oil or in water. In one example, the fire tube is submerged in water, and mixture CWG travels below the fire tube and mixture CWG bubbles up through the water. As mixture CWG bubbles up through the water, some light hydrocarbon gas G separates from unstabilized crude UC and exits heater-treater 11. Light hydrocarbon gas G is then either sent directly to flare, consumed as fuel, or can be processed through natural gas liquid (NGL) recovery system 30 (described with respect to FIG. 3 below) prior to being sent to flare or being used as a fuel source. Free water W is also separated from unstabilized crude UC and exits heater-treater 11 to be sent to storage.

During the separation process, heater-treater operates at a pressure between 35 and 50 psia and heats unstabilized crude UC to between 100 and 160° F., preferably to between 100 and 110° F. The heat breaks up any oil-water emulsions in mixture CWG, which assists in the separation process. In this range of temperatures, heater-treater 11 is not capable of reducing the volatility of unstabilized crude UC enough to produce stabilized crude. However, operating heater-treater 11 at this range of temperature prevents coking on the fire tube of heater-treater 11, and thus prevents failure of heater-treater 11. In order to operate heater-treater 11 at a high enough temperature to sufficiently reduce the RVP of unstabilized crude UC, the surface temperature of the fire tube would need to be close to 400° F., which would result in coking and failure of the fire tube.

Surge drum 12B controls fluctuations in pressure and flow of unstabilized crude UC flowing from heater-treater 11 in order to stabilize the flow rate of unstabilized crude UC upon entry into oil conditioning unit 10B. In some examples, surge drum 12B includes a water draw (not shown in FIG. 1B) in the event that any water becomes separated from unstabilized crude UC in surge drum 12B. Surge drum 12B also includes a water draw in the event that heater-treater 11 fails, so that oil conditioning unit 10B can still successfully condition unstabilized crude UC into stabilized crude SC.

The oil conditioning unit of this disclosure is designed to be compatible with any oil production system. As described above, oil conditioning unit 10A including three-phase separator 12A can be used if unstabilized crude oil is conditioned directly from a well. Oil conditioning unit 10B including surge drum 12B can be used if unstabilized crude oil is conditioned from a heater-treater, such as heater-treater 11. The oil conditioning unit of this disclosure operates downstream of the heater-treater, if a heater-treater is used, and upstream of stabilized crude storage. The oil conditioning unit can thus adapt to account for any issues that occur in the heater-treater. For example, if the heater-treater is malfunctioning, surge drum 12B of oil conditioning unit 10A has the capacity to remove water from unstabilized crude UC so that unstabilized crude UC can still be conditioned into stabilized crude SC. Conversely, if any issues occur in the oil conditioning unit, since the oil conditioning unit is downstream of any heater-treater, the oil conditioning unit will not affect operation of the rest of the oil production system.

In addition to compatibility with any oil production system, the oil conditioning unit of this disclosure eliminates the need for compressing light hydrocarbon gas G prior to sending light hydrocarbon gas G to flare or for use as a fuel source. Typically, light hydrocarbon gas needs to be compressed prior to being sent to flare or used as a fuel source, as a higher pressure is required to transport the gas to flare, for use as a fuel, or process the gas to recover NGL. Unstabilized crude UC can drop in pressure as it leaves a heater-treater or an oil well, which results in the need for compression. As described above, oil conditioning units 10A and 10B include pump 14, which pumps unstabilized crude UC to a pressure up to 150 psia prior to heating unstabilized crude PC and conditioning hot unstabilized crude HC in degassing vessel 20. As a result, light hydrocarbon gas G maintains a high enough pressure when exiting degassing vessel 20 and within oil conditioning unit 10A or 10B such that light hydrocarbon gas G does not need to be compressed for transport to flare, to fuel consumption, or to processing in NGL recovery system 30. Total gas flow G to flare, as a fuel source, or NGL recovery system 30 is the sum of gas flow G from the heater-treater 11 and light gases G from the degassing vessel 20. If any free water is separated in degassing vessel 20, it leaves degassing vessel 20 as stream W and flows to water storage along with separated water W from heater-treater 11.

Figure 2:
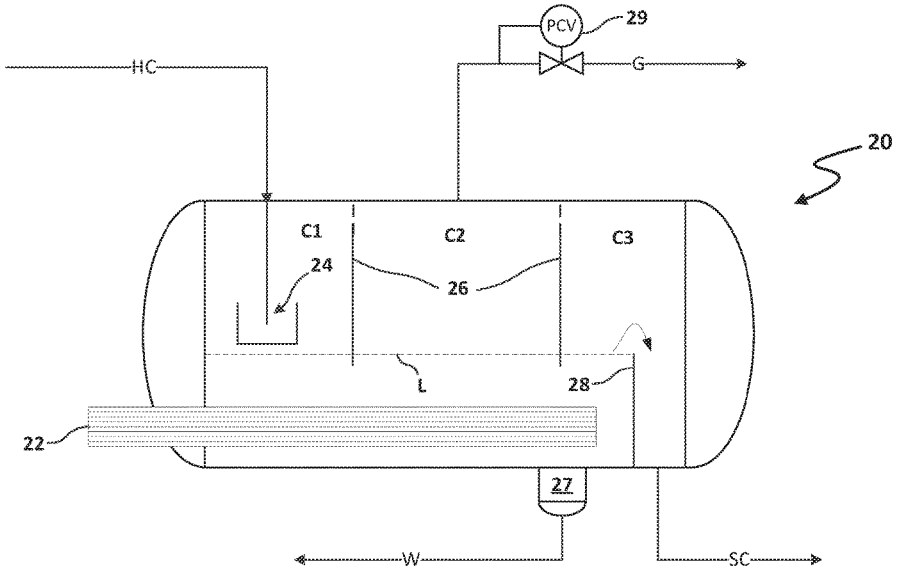
FIG. 2 is a schematic diagram of an example degassing vessel used in the oil conditioning units of FIGS. 1A-1B.

FIG. 2 is a schematic diagram of degassing vessel 20, which is used in oil conditioning units 10A and 10B of FIGS. 1A and 1B, respectively. Degassing vessel 20 includes heater 22, feed inlet distributor 24, underflow baffles 26, and overflow baffle 28. Degassing vessel 20 also includes chambers C1, C2, and C3, as well as liquid level L. As described above, hot unstabilized crude HC enters degassing vessel at a temperature between 200 and 275° F. and at a pressure between 20 and 100 psia. In one example, hot unstabilized crude HC enters degassing vessel 20 at a temperature of 240° F. and at a pressure of 35 psia. Degassing vessel 20 separates light hydrocarbon gases and water from hot unstabilized crude HC in order to condition hot unstabilized crude HC into stabilized crude SC.

Degassing vessel 20 maintains hot unstabilized crude HC at an appropriate temperature for a sufficient residence time in order to reduce the volatility of hot unstabilized crude HC to produce stabilized crude SC. In one example, the temperature within degassing vessel 20 is maintained at 240° F. for a residence time between 15 and 60 minutes. In another example, the residence time is between 30 and 45 minutes. In another example, the residence time is 30 minutes.

Underflow baffles 26 separate chambers C1 and C3 from chamber C2. The majority of the degassing occurs within chamber C2. Chamber C1 includes feed inlet distributor 24, and chamber C3 includes overflow baffle 28. Heater 22 spans chambers C1, C2, and C3, and ensures that hot unstabilized crude HC is maintained at an appropriate temperature within degassing vessel 20. In one example, heater 22 is an electric heater. Heater 22 is an optional component of degassing vessel 20. Heater 22 is a backup in case pre-heater 18 fails to heat hot unstabilized crude HC to a temperature at which enough light hydrocarbons can be separated to condition hot unstabilized crude HC into stabilized crude SC.

Feed inlet distributor 24 controls the distribution of hot unstabilized crude HC into degassing vessel 24. Feed inlet distributor 24 reduces the downward velocity of hot unstabilized crude HC as hot unstabilized crude HC enters degassing vessel 20. Hot unstabilized crude HC is distributed into chamber C1 such that liquid level L is maintained within degassing vessel 20. Liquid level L is set by the height of overflow baffle 28. Underflow baffle 26 segregates chamber C2 from chamber C1 such that the distribution of hot unstabilized crude HC into chamber C1 does not disturb the degassing occurring in chamber C2. Liquid flows under underflow baffle 26 from chamber C1 into chamber C2. Some light hydrocarbon gases may escape hot unstabilized crude HC in chamber C1, and those gases can flow into chamber C2 through holes at the top of underflow baffles 26. As shown in FIG. 2, both underflow baffles 26 have holes at the top so separated light gases can flow from chamber C1 and chamber C3 into chamber C2. In other examples, there can be a gap between underflow baffles 26 and the top of degassing vessel 20, or underflow baffles 26 can be flush with the top of degassing vessel 20. The separated light gases G are withdrawn from the top of chamber C2.

As hot unstabilized crude HC remains within degassing vessel 20 during an appropriate residence time, any free water W becomes separated from hot unstabilized crude HC, exits degassing vessel 20 and is sent to storage. As shown in FIG. 2, water W exits degassing vessel 20 upstream of overflow baffle 28. This ensures that separated water does not contaminate stabilized crude SC exiting degassing vessel 20. In some examples, water boot 27 may be installed upstream, of overflow baffle 28 to withdraw free water W. In chamber C2, the dissolved light hydrocarbons within hot unstabilized crude HC bubble up through the liquid and escape the liquid as light hydrocarbon gas G. Light hydrocarbon gases G leave degassing vessel 20 under pressure, preferably between 35 and 50 psia, and either travel to flare, are used as a fuel source, or travel to NGL recovery system 30. The pressure in degassing vessel 20 is maintained by pressure control valve 29, which throttles the flow of light gases G through a control valve. This ensures required operating pressure is maintained throughout oil conditioning units 10A and 10B. Since oil conditioning units 10A and 10B raise the pressure of hot unstabilized crude HC with pump 14, light hydrocarbon gas G exits degassing vessel 20 under sufficient pressure to travel to flare, for use as a fuel, or NGL recovery system 30. In one example, light hydrocarbon gas G exits degassing vessel 20 at a pressure between 35 and 60 psia.

When hot unstabilized crude remains within degassing vessel for a sufficient residence time, enough dissolved light hydrocarbons are removed in chamber C2 to produce stabilized crude SC. Stabilized crude SC overflows overflow baffle 28 into chamber C3 and exits degassing vessel 20. Some light hydrocarbon gases may escape in chamber C3, and those gases can flow into chamber C2 through holes at the top of underflow baffles 26. During the degassing process in degassing vessel 20, in some examples, de-emulsifiers can be injected into degassing vessel 20. Emulsions can occur during the degassing process, and injecting de-emulsifiers can facilitate efficient degassing by breaking the emulsions. In one example, stabilized crude SC exiting degassing vessel 20 has an RVP of 13.7 psia. In another example, stabilized crude SC exiting degassing vessel 20 has an RVP of 6 psia. In other examples, stabilized crude SC exiting degassing vessel 20 can have an RVP between 6 psia and 13.7 psia.

Figure 3:
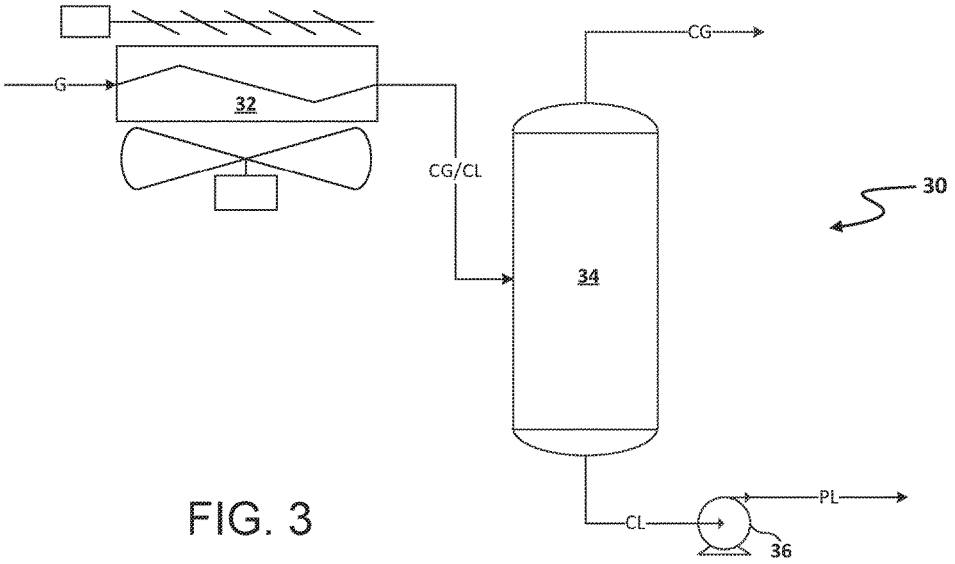
FIG. 3 is a schematic diagram illustrating an example natural gas liquid recovery system for recovering natural gas liquids from flare gas removed from unstabilized crude oil by the oil conditioning units of FIGS. 1A-1B.

FIG. 3 is a schematic diagram illustrating natural gas liquid (NGL) recovery system 30 for recovering natural gas liquid from flare gas exiting oil conditioning units 10A and 10B of FIGS. 1A-1B. NGL recovery system 30 is designed to minimize emissions from the oil conditioning units of this disclosure, such as oil conditioning units 10A and 10B. Additionally, NGL recovery system 30 can produce up to 25 barrels of NGL for every 475 barrels of stabilized crude produced. Thus, instead of increasing emissions by flaring separated light gases G, NGL recovery system 30 allows NGL to be recovered and repurposed, which is economically advantageous.

NGL recovery system 30 includes cooler 32, two-phase separator 34, and pump 36. Light hydrocarbon gas G exits degassing vessel 20 at a temperature of between 200 and 275° F. and a pressure of between 35 and 60 psia. After exiting degassing vessel 20, light hydrocarbon gas G enters cooler 32, where light hydrocarbon gas is cooled to a temperature between −20° F. and 120° F. In one example, cooler 32 can be an air cooler. In another example, cooler 32 can include a propane refrigeration cycle to cool light hydrocarbon gas G to as low as −20° F.

When light hydrocarbon gas G is cooled in cooler 32, primarily propane and butanes within light hydrocarbon gas G are condensed into condensed liquid CL. In order to condense the propane and butanes within light hydrocarbon gas G, light hydrocarbon gas G needs to remain at a high enough pressure. In one example, the pressure of light hydrocarbon gas G within cooler 32 is between 50 and 60 psia. As explained above, oil conditioning units 10A and 10B can include pump 14, which increases the pressure of unstabilized crude such that the pressure of light hydrocarbon gas G is sufficiently high when exiting degassing vessel 20. Light gases, including methane, ethane, and in some examples, nitrogen and argon, do not condense in cooler 32 and remain in a vapor state as cooled gases CG. A single stream containing cooled gases CG and condensed liquid CL flow from cooler 32 into two-phase separator 34.

Two-phase separator 34 separates condensed liquid CL from cooled gases CG. Cooled gases CG exit two-phase separator 34 and are sent to flare or consumed as fuel. By removing condensed liquid CL from light hydrocarbon gases G, the mass flow rate of cooled gases CG is significantly lower than the mass flow rate of light gases G, which reduces the flaring of hydrocarbons and reduces emissions. Condensed liquid CL is recovered from two-phase separator 34 and is sent to storage. In some examples, NGL recovery system can include pump 36. Pump 36 can be used to pump condensed liquid CL and send pumped liquid PL to storage or a pipeline for sales.

EXAMPLE

In an example oil conditioning unit of this disclosure, unstabilized crude UC is pumped by pump 14 to produce pressurized unstabilized crude PC at a pressure of 50 psia. Pressurized unstabilized crude PC is subsequently warmed to 179° F. in cross-exchanger 16. Warmed unstabilized crude WC exits cross-exchanger 16 and is heated to 240° F. in pre-heater 18. Pre-heater 18 includes two parallel heaters, with the energy for heating provided by electric coils.

Hot unstabilized crude HC exits pre-heater 18 and flows into degassing vessel 20. Hot unstabilized crude HC remains in degassing vessel 20 for a minimum residence time of 30 minutes to allow ample time for light hydrocarbons to rise through the liquid. Light hydrocarbon gas G exits degassing vessel 20, after which light hydrocarbon gas G may be vented to flare for destruction, used as fuel, or processed in NGL recovery system 30. If light hydrocarbon gas G is processed in NGL recovery system 30, cooler 32 cools light hydrocarbon gas G to 120° F. such that propane and butanes condense into condensed liquid CL. Condensed liquid CL is subsequently separated from cooled gas CG in two-phase separator 34.

Any excess water W present in hot unstabilized crude HC entering degassing vessel 20 settles at the bottom of degassing vessel 20 and exits to storage. Stabilized crude SC with an RVP of less than 7 psia is withdrawn from degassing vessel 20 and is cooled by cross-exchanger 16 to 120° F. prior to being sent to handling, storage and/or transport. The following table is an example performance summary of the oil conditioning unit of this example:

| Unstabilized Crude | | | Stabilized Crude | | |
|---|---|---|---|---|---|
| Flow rate | 500 | barrels/day | Flow rate | 475 | barrels/day |
| Pressure | 18.46 | psia | Pressure | 44 | psia |
| Temperature | 55° | F. | Temperature | 120° | F. |
| RVP | 15.03 | psia | RVP | 6.946 | psia |
| **Cross Exchanger** | | | **Pre-Heaters** | | |
| Cross Exchanger Duty | 332,000 | Btu/h | Unstabilized Crude Pre-Heaters Duty | 214,600 | Btu/h |
| Warm Unstabilized Crude Outlet Temperature | 179° | F. | Electrical Power | 62.9 | kWh |
| | | | Hot Unstabilized Crude Outlet Temperature | 240° | F. |
| **Gas to Flare** | | | **Pump and NGL** | | |
| Flowrate | 4,922 | standard cubic feet (SCF)/day | Crude Pump Power | 0.36 | HP |
| High Heating Value | 2,640 | Btu/SCF | NGL Product Flow | 21.9 | barrels/day |

The invention claimed is:

1. An oil conditioning unit comprising:

a pump for receiving unstabilized crude oil at a first pressure and pumping the unstabilized crude oil to a second pressure higher than the first pressure;

a first pre-heater downstream of the pump for heating the unstabilized crude oil to a first temperature; and a degassing vessel downstream of the first pre-heater, the degassing vessel configured to separate light hydrocarbon gases from the unstabilized crude oil at the first temperature to produce stabilized crude oil having a Reid Vapor Pressure less than or equal to 13.7 psia.

2. The oil conditioning unit of claim 1, wherein the degassing vessel is configured to produce stabilized crude oil having a Reid Vapor Pressure between 6 psia and 13.7 psia.

3. The oil conditioning unit of claim 1, wherein the degassing vessel comprises:

a feed inlet distributor configured to reduce a downward velocity of the unstabilized crude oil entering the degassing vessel;

a first underflow baffle and a second underflow baffle that form a chamber in which light hydrocarbon gases separate from the unstabilized crude oil; and an overflow baffle configured to allow the stabilized crude oil to flow over the overflow baffle and exit the degassing vessel;

wherein the first and second underflow baffles extend into the liquid at a level below the top of the overflow baffle.

4. The oil conditioning unit of claim 3, wherein the degassing vessel further comprises a heater for maintaining the unstabilized crude at a first temperature within the degassing vessel.

5. The oil conditioning unit of claim 1, wherein the pre-heater is an electric heater configured to heat the unstabilized crude oil to a temperature between 170 and 300 degrees Fahrenheit.

6. The oil conditioning unit of claim 1, further comprising a second pre-heater; wherein the first pre-heater and second pre-heater are parallel flooded heat exchangers.

7. The oil conditioning unit of claim 1, wherein the second pressure is between 50 and 150 psia.

8. The oil conditioning unit of claim 1, further comprising a surge drum upstream of the pump for regulating a flow rate of the unstabilized crude oil.

9. The oil conditioning unit of claim 1, further comprising a three-phase separator upstream of the pump.

10. The oil conditioning unit of claim 1, further comprising a cross-exchanger downstream of the pump and upstream of the pre-heater; wherein the cross-exchanger is configured to heat the unstabilized crude oil from the pump to a second temperature lower than the first temperature, and configured to cool the stabilized crude oil from the degassing vessel.

11. An oil conditioning system comprising:

a heater-treater configured to treat unstabilized crude oil;

an oil conditioning unit downstream of the heater-treater, the oil conditioning unit comprising:

a pump for receiving the unstabilized crude oil from the heater-treater at a first pressure and pumping the unstabilized crude oil to a second pressure higher than the first pressure;

a first pre-heater downstream of the pump for heating the unstabilized crude oil to a first temperature; and a degassing vessel downstream of the first pre-heater, the degassing vessel configured to separate light hydrocarbon gases from the unstabilized crude oil at the first temperature to produce stabilized crude oil having a Reid Vapor Pressure less than or equal to 13.7 psia; and a storage vessel for storing stabilized crude oil from the oil conditioning unit.

12. The oil conditioning system of claim 11, the oil conditioning unit further comprising a cross-exchanger downstream of the pump and upstream of the pre-heater; wherein the cross-exchanger is configured to heat the unstabilized crude oil from the pump to a second temperature lower than the first temperature, and configured to cool the stabilized crude oil from the degassing vessel.

13. The oil conditioning system of claim 11, the oil conditioning unit further comprising a surge drum upstream of the pump for regulating a flow rate of the unstabilized crude oil.

14. The oil conditioning system of claim 11, further comprising a natural gas liquid recovery system downstream of the oil conditioning unit.

15. The oil conditioning system of claim 14, wherein the natural gas liquid recovery system comprises:

a cooler configured to condense propane and butanes into condensed liquid from light hydrocarbon gas received from the oil conditioning unit; and a two-phase separator for separating the condensed liquid from light hydrocarbon gases.

16. The oil conditioning system of claim 11, wherein the degassing vessel is configured to produce stabilized crude oil having a Reid Vapor Pressure between 6 psia and 13.7 psia.

* * * * *